US006799402B2

(12) United States Patent
Faxe et al.

(10) Patent No.: US 6,799,402 B2
(45) Date of Patent: Oct. 5, 2004

(54) FLOOR TILE FLOORING CONNECTED BY TONGUE AND GROOVE-JOINTS AND COVERED FASTENERS

(75) Inventors: Per Faxe, Hornbæk (DK); Steen Mandsfelt Eriksen, Græsted (DK)

(73) Assignee: Faxe Design A/S, Hornbaek (DK)

( * ) Notice: Subject to any disclaimer, the term of this patent is extended or adjusted under 35 U.S.C. 154(b) by 0 days.

(21) Appl. No.: 10/663,550

(22) Filed: Sep. 15, 2003

(65) Prior Publication Data

US 2004/0107665 A1 Jun. 10, 2004

Related U.S. Application Data

(63) Continuation of application No. PCT/DK02/00188, filed on Mar. 21, 2002.

(30) Foreign Application Priority Data

Mar. 21, 2001 (DK) ..... 2001 00470
Nov. 28, 2001 (DK) ..... 2001 01766

(51) Int. Cl.[7] ..... E04F 13/08

(52) U.S. Cl. ..... 52/390; 52/391; 52/392; 52/480; 52/539; 411/372.5; 411/373

(58) Field of Search ..... 52/391, 390, 392, 52/403.1, 480, 539, 591.1, 591.4, 591.5, 263; 411/910, 372.5, 372.6, 373, 431; 403/408.1

(56) References Cited

U.S. PATENT DOCUMENTS

| | | | | | |
|---|---|---|---|---|---|
| 1,660,480 | A | * | 2/1928 | Stuart | 52/390 |
| 1,730,259 | A | * | 10/1929 | Clarence | 404/40 |
| 1,778,068 | A | * | 10/1930 | Werner | 52/391 |
| 1,929,871 | A | * | 10/1933 | Jones | 52/509 |
| 2,027,292 | A | * | 1/1936 | Rockwell | 52/396.1 |
| 2,088,238 | A | | 7/1937 | Greenway | 20/7 |
| 2,187,672 | A | | 1/1940 | Wedberg | 20/8 |
| 3,271,916 | A | * | 9/1966 | Omholt | 52/393 |
| 3,298,272 | A | * | 1/1967 | Henderson | 411/373 |
| 3,892,099 | A | * | 7/1975 | Worgan et al. | 52/479 |
| 4,056,878 | A | * | 11/1977 | Woodley | 29/525.11 |
| 4,296,586 | A | * | 10/1981 | Heurteux | 52/787.12 |
| 5,016,413 | A | * | 5/1991 | Counihan | 52/391 |
| 5,359,954 | A | * | 11/1994 | Kordelin | 114/85 |
| 5,412,917 | A | * | 5/1995 | Shelton | 52/403.1 |
| 5,570,554 | A | * | 11/1996 | Searer | 52/539 |
| 5,609,000 | A | * | 3/1997 | Niese | 52/480 |
| 5,941,047 | A | * | 8/1999 | Johansson | 52/747.1 |
| 5,988,966 | A | * | 11/1999 | Chen et al. | 411/372 |
| 6,122,873 | A | * | 9/2000 | Randjelovic | 52/403.1 |
| 6,164,031 | A | * | 12/2000 | Counihan | 52/480 |
| 6,470,641 | B1 | * | 10/2002 | Faure | 52/480 |

FOREIGN PATENT DOCUMENTS

| | | |
|---|---|---|
| FR | 855 351 | 5/1939 |
| FR | 906 658 | 3/1944 |
| GB | 827547 | 11/1956 |
| GB | 2 070 100 A | 2/1981 |
| JP | 11 100980 | 3/2001 |
| JP | 2001 059331 | 3/2001 |
| WO | WO 98/38401 | 9/1998 |
| WO | WO 01/66877 A1 | 9/2001 |

* cited by examiner

*Primary Examiner*—Carl D. Friedman
*Assistant Examiner*—Nahid Amiri
(74) *Attorney, Agent, or Firm*—Winston & Strawn LLP

(57) ABSTRACT

The invention relates to a floor with strips each defining a length and width and along the side and end edges provided with either end tongue or groove. The floor is laid in groups each including a number of tongue and groove assembled strips fastened to a subfloor by means of at least one fastener such as a screw or nail which is driven into the subfloor via at least one stepped transverse hole designed with at least one step in the respective strip and resting against the at least one step with a fastener head covered by a cover plug in the transverse hole. In mounted position, the plug is so stuck that it cannot be stepped down into the transverse hole by e.g. a spike heel which will not be able to damage or break the plug either, as the plug is made of a strong and durable metal such as e.g. bronze or steel. The length of each strip is longer than the width of the strip multiplied by the number of strips in a group. The strips engage each other in a strong and at the same time beautiful braided pattern.

22 Claims, 5 Drawing Sheets

FLOOR TILE FLOORING CONNECTED BY TONGUE AND GROOVE-JOINTS AND COVERED FASTENERS

CROSS-REFERENCE TO RELATED APPLICATIONS

This application is a continuation of International application PCT/DK/02/00188 filed Mar. 21, 2002, the entire content of which is expressly incorporated herein by reference thereto.

TECHNICAL FIELD

The invention relates to a floor with strips each defining a length and width and along the side and end edges provided with either tongue or groove configurations so that the strips can be joined together. The floor is laid in groups each comprising a number of tongue and groove assembled strips each fastened to a subfloor by means of at least one fastener such as a screw or nail which is driven into the subfloor via at least one stepped transverse hole designed with at least one step in the respective strip and resting against said at least one step with a fastener head covered by a cover plug in the transverse hole.

In a first aspect according to the invention, the cover plug is a metal-plug arranged to be retained at a distance from the fastener head without use of adhesives.

In a second aspect according to the invention, each group is provided with tongues and grooves which both allow adjacent strips in each group to be mutually tongue and groove assembled along their side edges, and allow the end edges of each group to be tongue and groove assembled with the side edges of a first and second adjacent group respectively in such a way that each of four adjacent groups will define a rectangular section filled by a filler piece having mainly the same thickness as the strips.

BACKGROUND ART

Floor strips for e.g., parquet floor are typically screwed onto the subfloor by means of screws having heads that rest against the step in each their stepped transverse hole. Then, the holes are closed at the top by means of glued-on wood plugs.

The work of gluing the many wood plugs which normally are used for a floor is most labor-consuming and to this should be added that the wood plugs are easily damaged and/or pressed into their respective holes by e.g. a spike heel. This presents a deficiency in such floors which needs correction.

SUMMARY OF THE INVENTION

This problem is now solved by the present invention wherein metal plugs are provided instead of wood plugs. These metal plugs are arranged to be retained at a distance from the respective screw heads and are installed without the use of adhesives.

The metal plugs can easily be driven into the transverse hole by means of for example a hammer or other force transferring device. If the plug has a greater external diameter than the corresponding section in the transverse hole, it is retained by the great friction which has been generated between the transverse hole and the plug during driving of the plug into the transverse hole. This friction is sufficiently great to effectively prevent the plug from being pressed further down into the hole by for example a spike heel or other point contact applied force. If the plug is made of a metal, such as for example bronze or steel, a further advantage is obtained in that it will be so strong that it cannot be damaged or broken by being stepped on by a spike heel.

The connection between the metal plug and the transverse hole can furthermore be strengthened by designing the cover plug with a screw thread. The plug can then be screwed or merely driven or even easier pressed down into the transverse hole. For the last purpose, a screw thread having small or no pitch can advantageously be used.

Compared to wood, metal is sufficiently strong so that the cover plug can be designed as a relatively thin disc resting on a second step designed in the transverse hole above the first step whereby expenses for metal are advantageously saved.

The invention also relates to a tongue and groove assembled floor that has strips which are quick and easy to put down and in laid state are kept together in a strong and permanently lasting connection and at the same time form a pattern which is more aesthetically beautiful than hitherto known. This is obtained by the length of each strip being longer than the width of the strip multiplied by the number of strips in a group. Thereby, the strips will engage each other in a strong and simultaneously beautiful braided pattern, in which the strips are held securely and strongly together with each other at both the side edges and the end edges.

For this purpose, relatively short strips are used of a length of between 10 and 100 cm, preferably between 30 and 90 cm and especially between 40 and 80 cm so that it is not necessary to discard as much wood as when the conventional relatively long strips are used. The floor according to the invention will therefore be relatively inexpensive to construct.

Between the strips, quadrangular sections are left which are filled with filler pieces of a suitable material which can be the same material as the strips or a metal such as e.g. bronze whereby a prominently beautiful design is obtained. The same effect can be obtained by applying a thin metal layer on a base such as e.g. wood whereby the same advantageous design is obtained at a substantially lower price than if the filler piece was completely of metal. The metal layer can advantageously be applied on both sides of the base so that the filler piece can be faced with a new side up when the initial side has been worn.

If the side tongue of each strip is located in the center of the respective side edge, the sections and thereby the filler pieces will be the same size whereby the floor forms a harmonic pattern. An especially beautiful and harmonic pattern is obtained if the side on the rectangular section is just as long as the width of the strip.

BRIEF DESCRIPTION OF THE DRAWINGS

The invention will be explained in greater detail below, describing only exemplary embodiments with reference to the drawing, in which.

DETAILED DESCRIPTION OF PREFERRED EMBODIMENTS

In the following description, it is assumed that the floor according to the invention is a floor made with wood strips. However, this is only to be taken as an example as the strips can be made of any other suitable kind of material, for example plastic or natural products such as marble.

Figure 1:
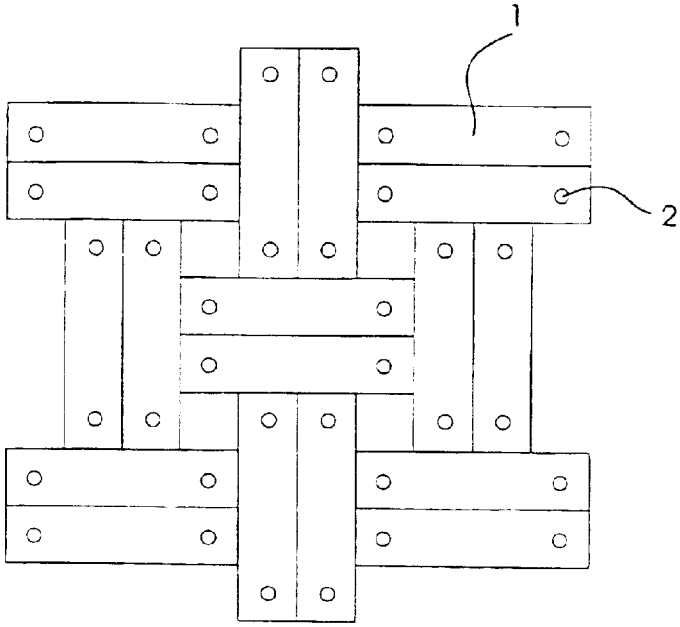
FIG. 1 is a fractional plan view of a parquet floor constructed of a number of parquet strips.

FIG. 1 shows a parquet floor with parquet strips 1 forming a braided pattern in this case. The strips are fastened to a subfloor (not shown in FIG. 1) by means of joints 2.

Figure 2:
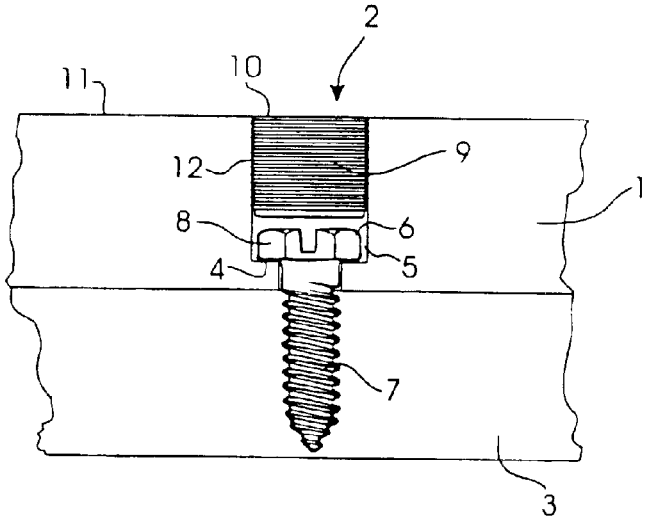
FIG. 2 is on a larger scale a fractional side sectional view of a first embodiment of a joint for fastening a parquet strip of the parquet floor in FIG. 1 to a subfloor.

FIG. 2 shows a first embodiment of such a joint 2 for fastening a parquet strip 1 to a subfloor 3. This joint comprises a stepped transverse hole 5 designed with at least one step 4 in the strip 1, a screw 6 screwed into the subfloor with the shank 7 via the transverse hole 5 and with the head 8 tightened against the step 4, and a metal plug 9 closing the transverse hole at the top with the top face 10 flush with the top face 11 of the strip 1.

As shown, the metal plug 9 is provided with a screw thread 12 having a small or no pitch in this case. The plug 9 can therefore be driven into the transverse hole 5 quickly and easily by means of e.g. a hammer (not shown). Thereby, the previous labor-intensive work of gluing cover plugs of wood is not necessary and the cost for doing this is eliminated. Alternatively, the plug can be provided with a screw thread having so great a pitch that the plug can be screwed down into the transverse hole quickly and easily.

It is important that the top face 10 of the plug be flush with the top side 11 of the strip. In order to allow the inevitable working tolerance of the arrangement, the plug is therefore dimensioned with a thickness that allow the lower face of the plug to keep a distance to the head of the screw when its top face is flush with the top face of the strip.

Even if the plug is not supported by the head of the screw, it is still retained effectively in its once mounted position in the transverse hole by friction and the engagement of the screw thread with the wall of the transverse hole. The joint is so strong that the plug is not pressed down into the transverse hole even if it is stepped on by a spike heel. Also, it is resistant to damage from such point loads because it is made of a durable metal.

To ensure that the mounted plug effectively will maintain its place in the transverse hole even if it is stepped hard on by e.g. a spike heel, the transverse hole is preferably drilled with a slightly smaller diameter than the external diameter of the plug to thereby obtain a very tight fit between the plug and the transverse hole.

Figure 3:
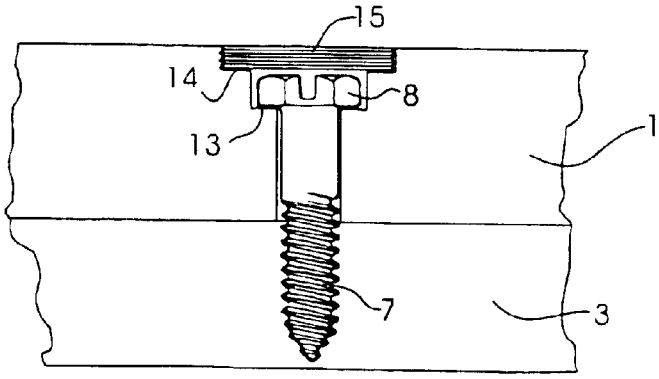
FIG. 3 is on a larger scale a fractional side sectional view of a second embodiment of a joint for fastening a parquet strip of the parquet floor in FIG. 1 to a subfloor.

FIG. 3 shows an alternative embodiment of an arrangement according to the invention. In this case, the parquet strip 1 is designed with both a lower step 13 and an upper step 14. The lower step 13 serves as abutment to the head 8 of the screw 6 in the same way as the step 4 in FIG. 2, whereas the upper step 14 serves for securely supporting the metal plug 15 at a distance from the screw head. The metal plug 15 is provided with a screw thread 16 having a small or no pitch in the case shown. The plug can therefore be fixed in the transverse hole quickly and easily.

Both in the first and the second embodiments of the invention, the metal plug can advantageously be designed with a bevel (not shown) or curvature (not shown) at the transition between the lower face and the peripheral outer side of the plug to ensure that the plug is easily caught by the transverse hole at mounting.

Figure 4:
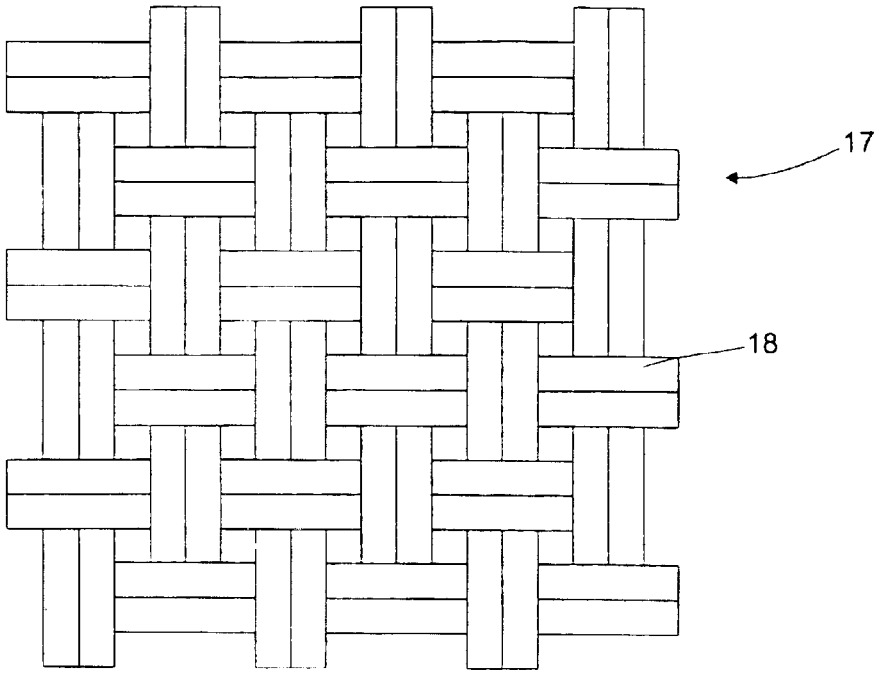
FIG. 4 is a plan view of a floor according to the invention, the plugs are not shown in this figure.
Figure 5:
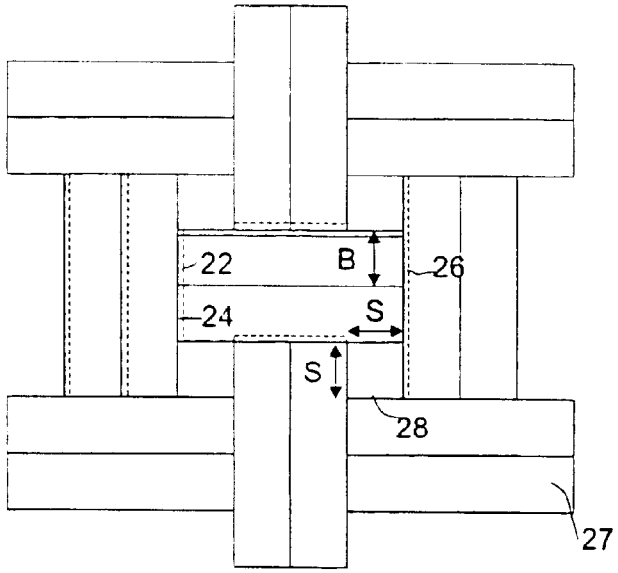
FIG. 5 is on a larger scale a fractional view of the floor in FIG. 4 in a first embodiment.
Figure 11:
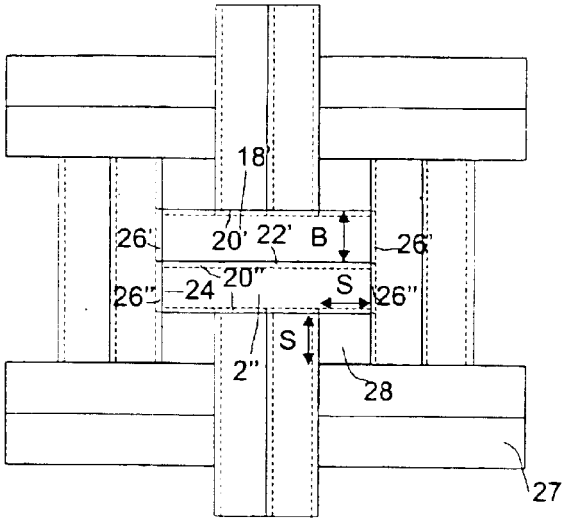
FIG. 11 is on a larger scale a fractional view of the floor in FIG. 4 in a second embodiment.

FIGS. 4 and 5 show a floor 17 with strips 18 forming in groups of two, in this case, a braid-like pattern. FIG. 4 shows the top surface of the floor while tongues and grooves are marked in dotted line on the strips in the fractional view of the same floor shown on a larger scale in FIGS. 5 and 11 of a first and second embodiment respectively.

FIGS. 6 to 9 show in detail how these tongues and grooves are made in a strip 18 of the first embodiment. A side groove 20 is made along one of the side edges 19 of the strip and a side tongue 22 along its second side edge 21. An end groove 24 is furthermore made along one of the end edges 7 of the strip and an end tongue 26 along its second end edge 25.

A floor is now laid in the following way according to the first embodiment. The strips are assembled in groups 27 of two strips each by means of their side grooves 20 and side tongues 22, after which each group is placed crosswise to two other groups and assembled with these groups with the end grooves in engagement with a side tongue on one of these groups and the end tongues in engagement with a side groove on the other group. Thereby, a strong bond is obtained between the strips which at the same time will form an aesthetically beautiful, braid-like pattern.

Figure 6:
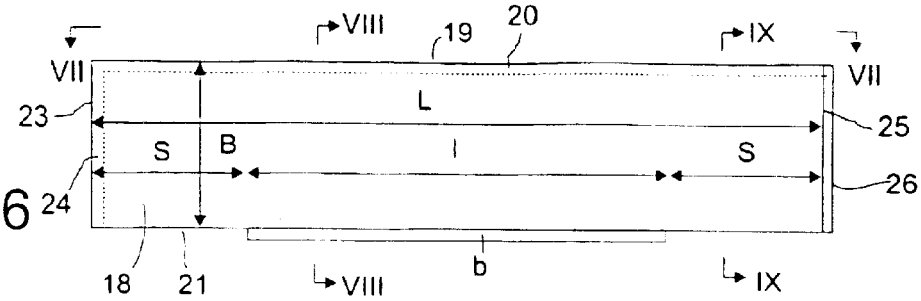
FIG. 6 is a side elevational view of a strip for the floor in FIGS. 4 and 5 in a first embodiment.
Figure 7:
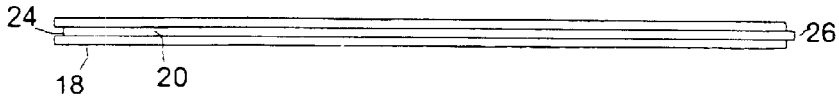
FIG. 7 is the same taken along the line VII—VII of FIG. 6.
Figure 8:
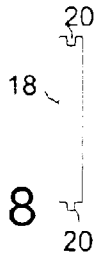
FIG. 8 is a sectional view taken along the line VIII—VIII of FIG. 6.
Figure 9:
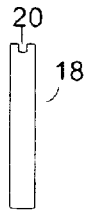
FIG. 9 is a sectional view taken along the line IX—IX of FIG. 6.

As shown in FIG. 6, the strip 18 has a length L and a width B. The side tongue 22 has a length 1 and is located in the center of the side edge 21. A portion s is therefore left without side tongue at each end of the side edge 21. In the case shown, the length 1 of the side tongue 22 is equal to two times the width B of the strip 18. Thereby, each of four strip groups will define a section 28 without strips.

FIGS. 12 to 16 show in detail how tongues and grooves are designed in a first strip 18' and a second strip 18" of the second embodiment. A side groove 20' is made along one of the side edges 19' of the strip 18' and a side tongue 22' along its second side edge 21'. End tongues 26' are made along each of the end edges 23' of the strip. Side grooves 20" are designed along the side edges 19" of each strip 18" and end tongues 26" are designed along the end edges 23" of each strip.

According to the second embodiment, the floor is laid in the following way. The first 18' and second strip 18" are joined in groups 27 by means of the side tongue 22' of the first strip and the side groove 20" of the second strip, after which each group is placed crosswise to two other groups and assembled with these groups with the end tongues 26', 26" in engagement with the side grooves 20', 20" on each of these groups. Thereby, a strong bond between the strips is obtained which at the same time will form an aesthetically beautiful, braid-like pattern.

Figure 12:
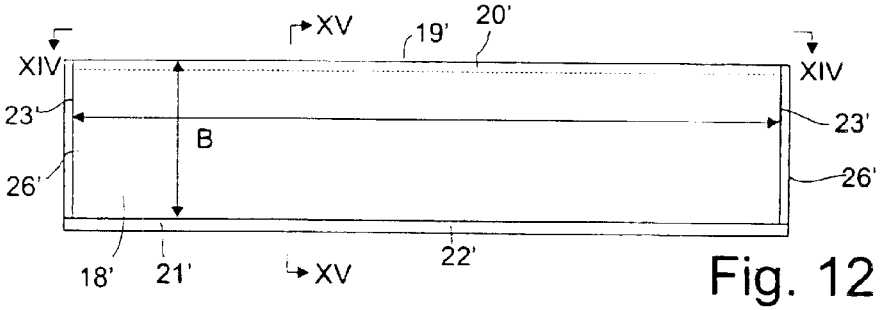
FIG. 12 is a side elevational view of a first strip for the floor in FIGS. 4 and 11 in a second embodiment.
Figure 13:
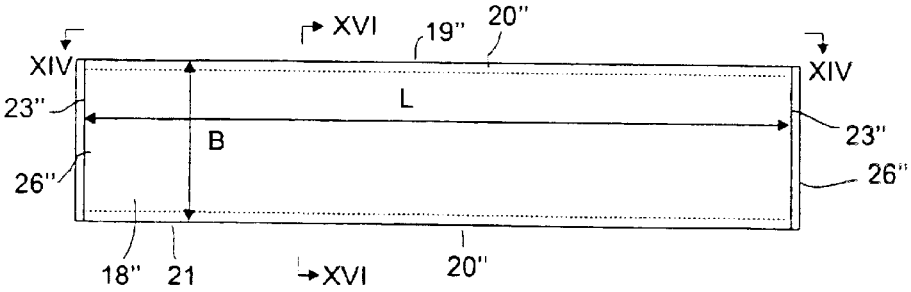
FIG. 13 is a side elevational view of a second strip for the floor in FIGS. 4 and 11.
Figure 14:
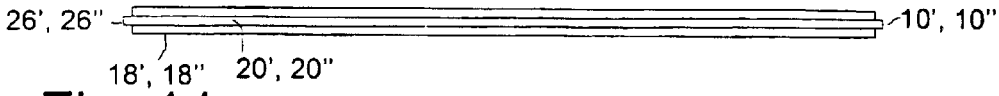
FIG. 14 is the same taken along the line XIV—XIV of FIGS. 12 and 13.
Figure 15:
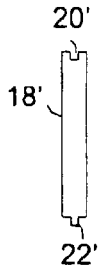
FIG. 15 is a sectional view taken along the line XV—XV of FIG. 12.
Figure 16:
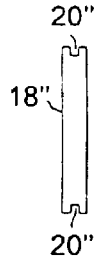
FIG. 16 is a sectional view taken along the line XVI—XVI of FIG. 13.

As shown in FIGS. 12 and 13, the strips 18', 18" will, when assembled in groups 28, leave the side edges without side tongues. This means that when the floor is laid, each of four strip groups will define a section 28 without tongues.

In both the first and second embodiments, a filler piece 29 of the same thickness as the strips 18 is fitted into each of these free sections 28 so that the strips together with the filler pieces will form a coherent whole having a beautiful and attractive design. The filler piece can either be completely without tongue and groove so that it quickly can be placed in the section 28 even after the rest of the floor has been laid. Alternatively, it can, in the second embodiment, have tongues on all edges so that the filler pieces will lie interlockingly. The filler piece 29 can be made of the same sort of wood as the strips or of wood contrasting the wood of the strips. Alternatively, the filler piece can be made of any other suitable material, of which metal, plastic, glass or marble can be mentioned. In addition to that, the filler piece can comprise for example outlets so that wires for computers or the like can be passed under the floor and therefore need not be left lying on the floor.

Figure 10:
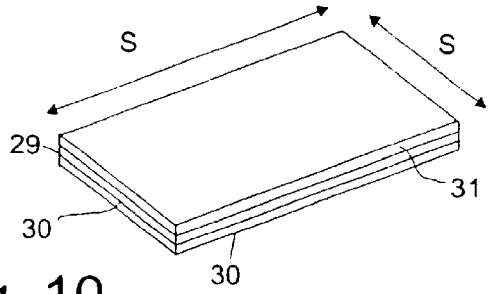
FIG. 10 is a perspective view of a filler piece for the floor in FIG. 4.

The filler piece 29 in FIG. 10 has a core 30 of wood clad by a thin metal sheet 31. Thereby, a filler piece is formed which is both inexpensive to manufacture and at the same time gives the floor a design with a sprinkling of the exclusive grand appearance of the metal. The metal sheet can for example be of brass, it should however be noted that other metals also can be used for the sheet. Furthermore, the sheet can be made of any other kind of suitable material.

If a metal sheet is located on both sides of the core as shown, the filler piece can be inverted so that a new metal sheet will face upwards when the metal sheet that previously faced upwards has been worn and therefore no longer look sufficiently nice.

If a metal sheet is only located on one side, the filler piece can be inverted when the floor is to be ground. When the side having the metal sheet then is faced upwards again, the filler piece will have obtained the same height as the rest of the floor.

The length of each strip can advantageously be a multiple of e.g. 2 to 6 of its width whereby the floor will form a harmonic pattern. Furthermore, the number of strips in a group need not be 2 but can be any other suitable number, for example 1 to 4.

It is to be mentioned that the floor strips can be screwed onto the subfloor. If this is done, the screw heads will show on the floor. Therefore, the screws are normally hidden by means of filling plugs. These are normally massive to ensure that e.g. spike heels cannot sink down through the plug.

An alternative way of solving this problem is by designing the plug of a massive material, such as metal, and then screw this plug into the floor. If a metal is used, it is advantageously obtained that the plug can be made of a very thin filler piece of metal, e.g. copper, which is considerably less expensive than the massive plug. This plug can also cover a screw head. As this plug is considerably thinner than hitherto known, it is necessary to design the hole in which the plug is to be placed with shoulders so that the plug will be flush with the rest of the floor. Furthermore, the plug can advantageously be glued or taped on instead of being screwed on which will make the work process faster and thereby the finished floor less expensive.

What is claimed is:

1. A floor with strips each defining a length and width and having side and end edges, and being provided with either end tongues or end grooves along the side and end edges, the strips being placed in groups each comprising a number of tongue and groove assembled strips each group fastened to a subfloor by at least one fastener which is driven into the subfloor through at least one stepped transverse hole provided on at least one strip of the group, the hole designed with at least one step in the strip and resting against the at least one step with a fastener head covered by a cover plug in the transverse hole, wherein the cover plug is a metal plug arranged to be retained at a distance from the fastener head without use of adhesives.

2. A floor according to claim 1, wherein the metal plug has a larger external diameter than the corresponding section of the stepped transverse hole in the floor strip.

3. A floor according to claim 1, wherein the metal plug is designed with a screw thread.

4. A floor according to claim 3, wherein the pitch of the screw thread is small or zero.

5. A floor according to claim 1, wherein a lower step is made in the at least one transverse hole serving as abutment to the head on the employed fastener, and an upper step serving as abutment to the lower face of the metal plug.

6. A floor according to claim 5, wherein the metal plug is configured in the form of a disc.

7. A floor according to claim 1, wherein the metal plug is made of copper, bronze or steel.

8. A floor according to claim 1, wherein the fastener is a screw or nail.

9. A floor with strips each defining a length and width and having side and end edges, and being provided with either end tongues or end grooves along the side and end edges, the strips being placed in groups each comprising a number of tongue and groove assembled strips each group fastened to a subfloor by at least one fastener which is driven into the subfloor through at least one stepped transverse hole provided on at least one strip of the group, the hole designed with at least one step in the strip and resting against the at least one step with a fastener head covered by a cover plug in the transverse hole, wherein each group is provided with tongues and grooves that both allow adjacent strips of each group to be mutually tongue and groove assembled along their side edges, and allow the end edges of each group to be tongue and groove assembled with the side edges of a first and second adjacent group respectively in such a way that each of four adjacent groups will define a rectangular section which is filled by a filler piece having essentially the same thickness as the strips.

10. A floor according to claim 9, wherein each strip has a length that is longer than its width multiplied by the number of strips in the group.

11. A floor according to claim 9, wherein each strip is provided with an end tongue at each end edge and that at least one strip in each group has a side tongue and a side groove and at least another strip in the same group has two side grooves.

12. A floor according to claim 9, wherein each strip is provided with an end tongue at one of its end edges and an end groove at the other end edge, and a side groove and an opposite side tongue.

13. A floor according to claim 9, wherein the side tongues of each strip is located in the center of the respective side edge.

14. A floor according to claim 9, wherein each strip has a length of between 20 and 100 cm.

15. A floor according to claim 9, wherein each strip has a length of between 30 and 90 cm.

16. A floor according to claim 9, wherein each strip has a length of between 40 and 80 cm.

17. A floor according to claim 9, wherein the number of strips in a group is between 2 and 4.

18. A floor according to claim 17, wherein the filler piece is made of the same material as the strips.

19. A floor according to claim 17, wherein the filler piece is made of metal.

20. A floor according to claim 17, wherein the filler piece includes a metal layer on one or both sides of a non-metal.

21. A floor according to claim 20 wherein the non-metal is wood.

22. A floor according to claim 9, wherein the fastener is a screw or nail.

* * * * *